US007048826B2

(12) United States Patent
Archer et al.

(10) Patent No.: US 7,048,826 B2
(45) Date of Patent: May 23, 2006

(54) METHOD FOR TARGETED APPLICATION OF PERFORMANCE ENHANCING MATERIALS TO A CREPING CYLINDER

(75) Inventors: Sammy L. Archer, Lynnwood, WA (US); Gary S. Furman, Jr., St. Charles, IL (US)

(73) Assignee: Nalco Company, Naperville, IL (US)

( * ) Notice: Subject to any disclaimer, the term of this patent is extended or adjusted under 35 U.S.C. 154(b) by 16 days.

(21) Appl. No.: 10/806,205

(22) Filed: Mar. 22, 2004

(65) Prior Publication Data

US 2004/0177940 A1 Sep. 16, 2004

Related U.S. Application Data

(62) Division of application No. 10/261,026, filed on Sep. 30, 2002.

(51) Int. Cl.
*D21H 11/00* (2006.01)

(52) U.S. Cl. ..... 162/111; 162/184; 162/264; 162/281; 162/280

(58) Field of Classification Search ..... 162/111, 162/184, 264, 281, 280
See application file for complete search history.

(56) References Cited

U.S. PATENT DOCUMENTS 4,176,668 A * 12/1979 Fiore et al. ..... 131/353
5,382,323 A 1/1995 Furman et al.
6,048,938 A * 4/2000 Neal et al. ..... 525/185
6,277,242 B1 8/2001 Archer et al.
6,425,983 B1 7/2002 Marinack et al.
6,485,610 B1 * 11/2002 Loippo ..... 162/198

OTHER PUBLICATIONS

Essco Incorporated Web Cite, www.esscoincorporated.com/systems First printout blade holders/creping, second printout droverview, Sep. 10, 2002.
Pacific, Division of Pacific/HOE Saw & Knife Company www.pacific-hoe/com/products/paper/crepe.htm, Sep. 10, 2002.
James Ross, Ltd. Web Cite, www.jamesross.com/english/doctorguide/Crepe/yankee_creping.htm, pp. 1-2, Sep. 10, 2002.
Bender web cite, www.bendermachine.com/release03.htm, pp. 1-2, Sep. 10, 2002 Bender introduces New Yankee Dryer Coating Called Infinikote™.
Prodry technology, Inc., Webcite www.prodry.com/creping.html pp. 1-2, Sep. 10, 2002, "Creping Blade Profiles".

* cited by examiner

*Primary Examiner*—Mark Halpern
(74) *Attorney, Agent, or Firm*—Thomas M. Breininger

(57) ABSTRACT

A method for target application of a Performance Enhancing Material to a creping cylinder in order to improve a tissue making operation is described and claimed. The method involves dividing the creping cylinder into Zones and then applying the desired Performance Enhancing Material on a Zone by Zone basis such that each Zone has the optimal Performance Enhancing Material present. Furthermore, a method to ascertain the amount and pattern of application of the Performance Enhancing Material used on the creping cylinder is described and claimed. This method involves adding an inert fluorescent tracer to said Performance Enhancing Material and then to use a fluorometer to look for the tracer on the creping cylinder, and/or on the creped tissue product and/or in the water removed from the felt.

4 Claims, 5 Drawing Sheets

METHOD FOR TARGETED APPLICATION OF PERFORMANCE ENHANCING MATERIALS TO A CREPING CYLINDER

This application is a DIV of application Ser. No. 10/261,026 filed on 30 Sep. 2002

FIELD OF THE INVENTION

This invention is in the field of pulp and paper manufacture. Specifically, this invention is in the field of improving performance of a creping cylinder during the making of tissue.

BACKGROUND OF THE INVENTION

In the manufacture of paper tissues, the wet web of fibers, a.k.a. the wet paper sheet, is formed on a fourdrinier or crescent former or twin wire, then transferred via a felt to a steam heated metal cylinder and dried thereon. The steam heated metal cylinder is typically known as the creping cylinder or "Yankee Dryer". As the wet web of fibers rotates on the cylinder, much of the water is driven off leaving a web of fibers with from about 50 to about 99 weight percent solids. A metal blade, known as a creping blade, is then used to remove the web of fibers and in the process of removing the web the metal blade compacts the sheet in the machine direction which produces a folding action. This removal and compacting process is known as "creping". Creping causes the paper sheet to wrinkle or pucker. Creping often destroys a large number of fiber to fiber bonds in the paper sheet thereby imparting qualities of bulk, stretch, absorbency and softness characteristics to the tissue paper being manufactured.

In tissue making it is normal practice to spray a dilute adhesive solution through a spray boom onto the heated metal surface of a creping cylinder to aid in adhesion of a web of fibers to the creping cylinder for drying and subsequent creping. This adhesive material provides adequate adhesion of the web of fibers to the creping cylinder which enhances the manufacture of quality tissue, helps protect the dryer from excessive wear, provides lubrication for the doctor blades and is soft enough to allow doctor blade tip penetration for good creping. After encountering the layer of adhesive on the creping cylinder, typically the web of fibers is adhered to the cylinder using a pressure roll or suction pressure roll that is positioned such that the web of fibers encounters the pressure roll nip (the pressure roll nip being the point of contact between the pressure roll and the creping cylinder) at approximately the same time that the web of fibers encounters the layer of adhesive. The sheet then continues around the heated cylinder to be creped off with a metallic blade. In the creping process valued attributes such as softness, absorbency and bulk are built into the sheet. After the web of fibers has been removed from the creping cylinder by the creping blade, state of the art techniques currently call for spraying the surface of the creping cylinder again with the dilute adhesive solution and the creping process is continued.

After the web of fibers has been removed from the creping cylinder by the creping blade, some material, which may include heat-solidified adhesive and stray fibers, is typically left on the surface of the dryer. The material left on the surface of the dryer tends to adhere to the surface and the build-up eventually gets large enough to be described as a "deposit". Deposits at the edge of the fiber web due to residual adhesive solution being baked onto the cylinder are a major problem because the presence of the deposit leads to uneven coating of the cylinder with the fiber mat and that can lead to doctor blade chattering and poor runnability and that can lead to unwanted breakage of the fiber mat.

Another known problem with the creping process is that the edges of the creping cylinder that have no web of fibers or felt in contact tends to be at a temperature higher than the temperature at the center part of the creping cylinder. The resulting temperature gradient that is in existence across the cylinder can cause uneven processing of the wet mat of fibers.

With each section of the creping cylinder having a different performance requirement and each section of the creping cylinder having an operating temperature range that is different from the adjacent section it then becomes apparent that it is difficult to maintain good runnability of the creping cylinder.

Past attempts to improve runnability by adding one or more modifiers to the dilute adhesive solution have not been optimal because there has yet to be one modifier identified that can improve runnability across the entire length of the creping cylinder. It would be desirable then to have a way of improving the performance of a creping cylinder to correct the problems associated with the temperature gradient across the creping cylinder and the problems associated with deposits left on the creping cylinder.

SUMMARY OF THE INVENTION

The first aspect of the instant claimed invention is a method for targeted application of Performance Enhancing Materials to a creping cylinder comprising the steps of:

a) providing a tissue making operation wherein a rotating creping cylinder is used to dry a wet mat of fibrous material wherein said mat of fibrous material is contacted with a doctor blade that crepes the fibrous mat as it leaves the creping cylinder;

b) dividing said creping cylinder into a plurality of Zones, wherein each Zone has a performance requirement and operating temperature range that is different than the adjacent Zone;

c) providing means for targeted application of one or more desired Performance Enhancing Materials to each Zone of said creping cylinder; and d) applying one or more Performance Enhancing Materials to at least two Zones of said creping cylinder, wherein the Performance Enhancing Material applied to each Zone is selected based on the performance requirement and operating temperature range of each Zone of said creping cylinder.

The second aspect of the instant claimed invention is an apparatus useful for targeted application of Performance Enhancing Materials to a creping cylinder comprising means for applying specific Performance Enhancing Materials to each Zone of a creping cylinder, wherein said means must be capable of targeted delivery such that there is minimal undesired overlap of application of Performance Enhancing Materials on adjacent Zones and wherein said means must also be capable of functioning continuously so there is no unplanned for interruption in the application of Performance Enhancing Materials during operation of said creping cylinder.

The third aspect of the instant claimed invention is a method to detect whether a Performance Enhancing Material is present on a creping cylinder comprising the steps of:

a) adding a known amount of an inert fluorescent tracer to a known amount of a Performance Enhancing Material, with said Performance Enhancing Material being suitable for application to a creping cylinder;

b) applying said Performance Enhancing Material to creping cylinder;

c) using a fluorometer to measure the fluorescent signal of said inert fluorescent tracer on said creping cylinder;

d) using the fluorescent signal of said inert fluorescent tracer to determine the amount of inert fluorescent tracer present on said creping cylinder;

e) correlating the amount of inert fluorescent tracer present on said creping cylinder with the amount of Performance Enhancing Material present on said creping cylinder;

f) comparing the amount of Performance Enhancing Material present on said creping cylinder with the desired amount of Performance Enhancing Material that is supposed to be present on said creping cylinder; and optionally g) adjusting the amount of Performance Enhancing Material present on said creping cylinder, based on the measured fluorescent signal of said inert fluorescent tracer.

The fourth aspect of the instant claimed invention is a method to detect whether a Performance Enhancing Material is present on a creped tissue product comprising the steps of:

a) adding a known amount of an inert fluorescent tracer to a known amount of a Performance Enhancing Material, with said Performance Enhancing Material being suitable for application to a creping cylinder;

b) applying said Performance Enhancing Material to a creping cylinder;

c) using a fluorometer to measure the fluorescent signal of said inert fluorescent tracer on the creped tissue leaving said creping cylinder and repeating this measurement as required in order to determine the pattern of the presence and amount of said Performance Enhancing Material on said creped tissue;

d) using the pattern of the presence and amount of said Performance Enhancing Material on said creped tissue to ascertain whether the application of Performance Enhancing Material to said creping cylinder is optimal; and optionally;

e) adjusting the amount of Performance Enhancing Material present on said creping cylinder, based on the pattern of the presence and amount of said Performance Enhancing Material on said creped tissue.

The fifth aspect of the instant claimed invention is a method to detect whether the correct amount and type of Performance Enhancing Materials are present on a creping cylinder comprising the steps of:

a) adding a known amount of an inert fluorescent tracer to a known amount of a Performance Enhancing Material, with said Performance Enhancing Material being suitable for application to a creping cylinder;

b) applying said Performance Enhancing Material to a creping cylinder;

c) using a fluorometer to measure the fluorescent signal of said inert fluorescent tracer in the collected water removed from the felt;

d) using the fluorescent signal of said inert fluorescent tracer to determine the amount of inert fluorescent tracer present in the collected water removed from the felt;

e) correlating the amount of inert fluorescent tracer present in said collected water removed from the felt with the amount of Performance Enhancing Material present in said water removed from the felt;

f) comparing the amount of Performance Enhancing Material present in the water removed from the felt with the desired amount of Performance Enhancing Material that is supposed to be present on said creping cylinder; and optionally g) adjusting the amount and type of Performance Enhancing Material present on said creping cylinder, based on the measured fluorescent signal of said inert fluorescent tracer found in the water removed from the felt.

BRIEF DESCRIPTION OF THE FIGURES

FIG. 1 does not depict the instant claimed invention.

FIG. 2 does not depict the instant claimed invention.

DETAILED DESCRIPTION OF THE INVENTION

The following terms have the indicated meanings throughout this patent application:

"Creping" refers to the intentional wrinkling of paper during drying to produce a soft, elastic sheet of tissue paper. A creping blade, aka a Doctor blade, is used to intentionally wrinkle the paper.

A "doctor blade" is used to remove something from a rotating cylinder. A "creping blade" is a special type of "doctor blade". All creping blades are doctor blades, but not all doctor blades are creping blades.

A "humectant" is a substance having affinity for water with stabilizing action on the water content of a material. A humectant keeps the moisture content caused by humidity fluctuations within a narrow range. When used in a creping process a humectant is used to keep the moisture content of the Performance Enhancing Material at the desired level such that the Performance Enhancing Material can promote optimal adhesion of the web to the creping cylinder.

A "low molecular weight polymer" has a weight average molecular weight of from about 1000 to about 200,000.

A "plasticizer" is an organic compound added to a high molecular weight polymer both to facilitate processing and to increase the flexibility and toughness of the Performance Enhancing Material.

A "surfactant" is any compound that reduces surface tension when dissolved in water or water solutions, or any compound that reduces interfacial tension between two liquids.

"Tissue" refers to paper towels, paper napkins, paper facial tissue, toilet paper, diaper carrier paper, glazed tissue paper, sanitary tissue and hygienic paper products.

A "Yankee Dryer" is another term,{mostly used in North America} for a creping cylinder that is used to crepe tissue.

The first aspect of the instant claimed invention is a method for targeted application of Performance Enhancing Materials to a creping cylinder comprising the steps of:

a) providing a tissue making operation wherein a rotating creping cylinder is used to dry a wet mat of fibrous material wherein said mat of fibrous material is contacted with a doctor blade that crepes the fibrous mat as it leaves the creping cylinder;

b) dividing said creping cylinder up into a plurality of Zones, wherein each Zone has a performance requirement and operating temperature range that is different than the adjacent Zone;

c) providing means for targeted application of a desired Performance Enhancing Materials to each Zone of said creping cylinder; and d) applying one or more Performance Enhancing Materials to at least two Zones of said creping cylinder, wherein the Performance Enhancing Material applied to each Zone is selected based on the performance requirement and operating temperature range of each Zone of said creping cylinder.

Figure 1:
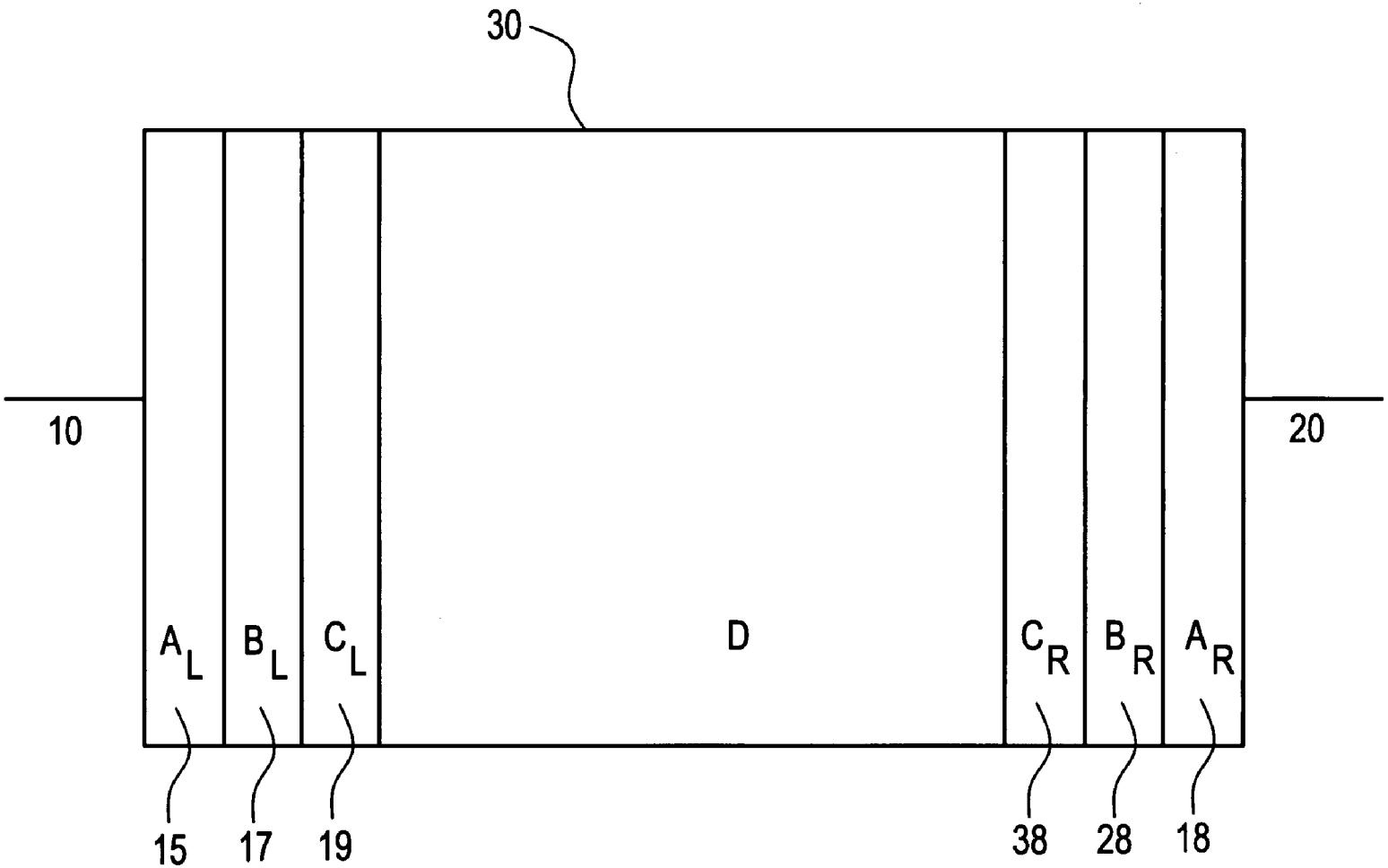
FIG. 1 illustrates the different Zones present on the surface of a creping cylinder, with the subscript L referring to the left-hand side and the subscript R referring to the right-hand side.

Referring now to FIG. 1, Creping Cylinder 30 is shown. In current, commercial tissue making production plants the Creping Cylinders being used are typically between about 100 inches and about 328 inches across. The most common distance across Creping Cylinder is between about 200 inches and about 260 inches.

Figure 2:
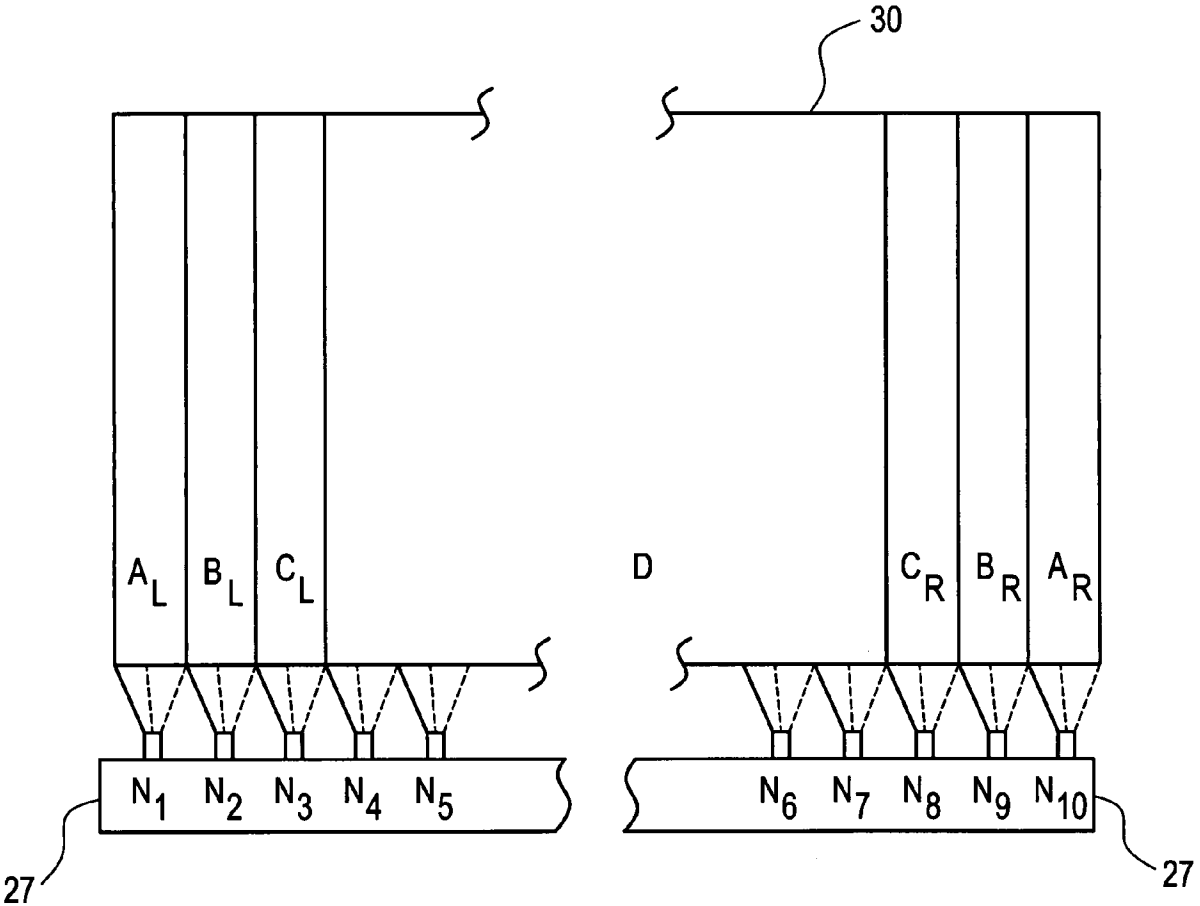
FIG. 2 illustrates the different Zones present on the surface of a creping cylinder and shows a spray boom positioned in such a way relative to the surface of the creping cylinder that each spray nozzle applies material to only one Zone.

In FIG. 1, Zone $A_L$, 15, and Zone $A_R$, 18, are shown, wherein Zone A on either the left or right side is defined as the outside edge of the creping cylinder. Zones $A_L$ and $A_R$ are outside of the part of the cylinder covered by the mat of fibrous tissue and also outside the part of the cylinder that contacts the felt carrying the wet mat of fibrous tissue to the dryer. Performance Enhancing Materials are normally applied to Zone A by spray boom 27, shown in FIG. 2. In FIG. 2, Nozzle $N_1$ supplies Zone $A_L$, 15, and Nozzle $N_{10}$ applies Performance Enhancing Material to Zone AR, 18. Zone $A_L$ and Zone $A_R$ are the hottest Zones on the creping cylinder because the wet mat of fibrous material does not come into contact with Zone $A_L$ or Zone $A_R$ so there can be no cooling effect on these Zones.

In FIG. 1, the steam that is used to provide the heat for drying enters creping cylinder 30 on the left side through Steam Line 10 and the condensate leaves cylinder 30 through condensate line 20. There is no standard amount of cylinder distance encompassing Zone $A_L$ or Zone $A_R$. The typical temperature range in Zone $A_L$ and in Zone $A_R$ is between about 95° C. and about 170° C.

A coating is required in Zone $A_L$ and Zone $A_R$ in order to prevent the doctor blade from scraping against the bare metal of the creping cylinder. If there is a lack of coating in Zone A to provide a protecting, lubricating barrier between the crepe blade and the creping cylinder, then excessive wear and "burning" of the blade will occur. This can also cause excessive wear of the creping cylinder itself.

Zone B on the creping cylinder is defined as extending from the inside edge of where the felt contacts the creping cylinder to just outside of the edge of the mat of fibrous tissue. This edge is also known as the tissue sheet trim track (edge of the tissue sheet). FIG. 1 clearly shows Zone $B_L$, 17, and Zone $B_R$, 28. There is no standard amount of cylinder distance encompassing Zone $B_L$ or Zone $B_R$. The typical temperature range in Zone B is between about 90° C. and about 120° C.

Performance Enhancing Materials are normally applied to Zone B by spray boom 27, shown in FIG. 2. In FIG. 2, Nozzle $N_2$ supplies Zone $B_L$, 17, and Nozzle $N_9$ applies Performance Enhancing Material to Zone $B_R$, 28.

Zone B is that area where it is most likely that problematical edge deposits occur. This is because adhesive is applied to the creping cylinder in this area, see FIG. 2, Nozzles $N_2$ and $N_9$ for spray application of adhesive. In addition to the adhesive being present in Zone B, the felt that supports the web of tissue can also deposit additional unwanted material on the creping cylinder in this zone. The creping blade removes most of this adhesive and unwanted material, but some adhesive remains on the cylinder and with time a build-up of deposit can take place. If there is a deposit that builds up and is not removed through normal operation of the creping or cleaning doctor blades, then the doctor blade chatters and can be lifted away from the cylinder.

Another type of problem encountered in Zone B is excessive wear of the Doctor blade.

Zone C is defined as approximately 3 to 9 inches inside or outside of the tissue sheet trim track. As stated previously, the tissue sheet trim track is the trimmed edge of the wet mat of fibrous material. FIG. 1 clearly shows Zone $C_L$, 19, and Zone $C_R$, 38. As stated previously, the cylinder distance encompassing Zone $C_L$ or Zone $C_R$ is approximately 3 to 9 inches. The typical temperature range in Zone C is between about 90° C. and about 110° C.

Performance Enhancing Materials are normally applied to Zone C by spray boom 27, shown in FIG. 2. In FIG. 2, Nozzle $N_3$ supplies Zone $C_L$, 19, and Nozzle $N_8$ applies Performance Enhancing Material to Zone $C_R$, 38.

If the wet mat of fibrous material is too loose as it dries in Zone C, that is an indication of poor adhesion between the mat and the creping cylinder. If excess wear of the creping blade is found in Zone C, then additional Performance Enhancing Materials have to be applied to this Zone. Picking is where the drying mat of fibrous material is so tightly adhered to the creping cylinder that it starts to travel underneath the doctor blade. Picking is highly undesirable as it creates holes in the sheet, with those holes causing breaks of the web. If picking is occurring in Zone C, due to higher adhesion and temperature in this Zone, then a different amount and type of Performance Enhancing Material needs to be applied.

Zone D, 21, is that area of the creping cylinder surface which is covered by the drying tissue sheet except for the trim track area which is encompassed by Zone C. There is no standard amount of cylinder distance encompassing Zone D. The typical temperature range in Zone D is between about 85° C. and about 95° C.

Performance Enhancing Materials are normally applied to Zone D by spray boom 27, shown in FIG. 2. In FIG. 2, Nozzles $N_4$, $N_5$, $N_6$ and $N_7$ apply Performance Enhancing Materials to Zone D. The tissue sheet may be too loose in Zone D, it may be too tight, causing picking or there may be other performance problems in Zone D that require the application of a Performance Enhancing Material.

Figure 3:
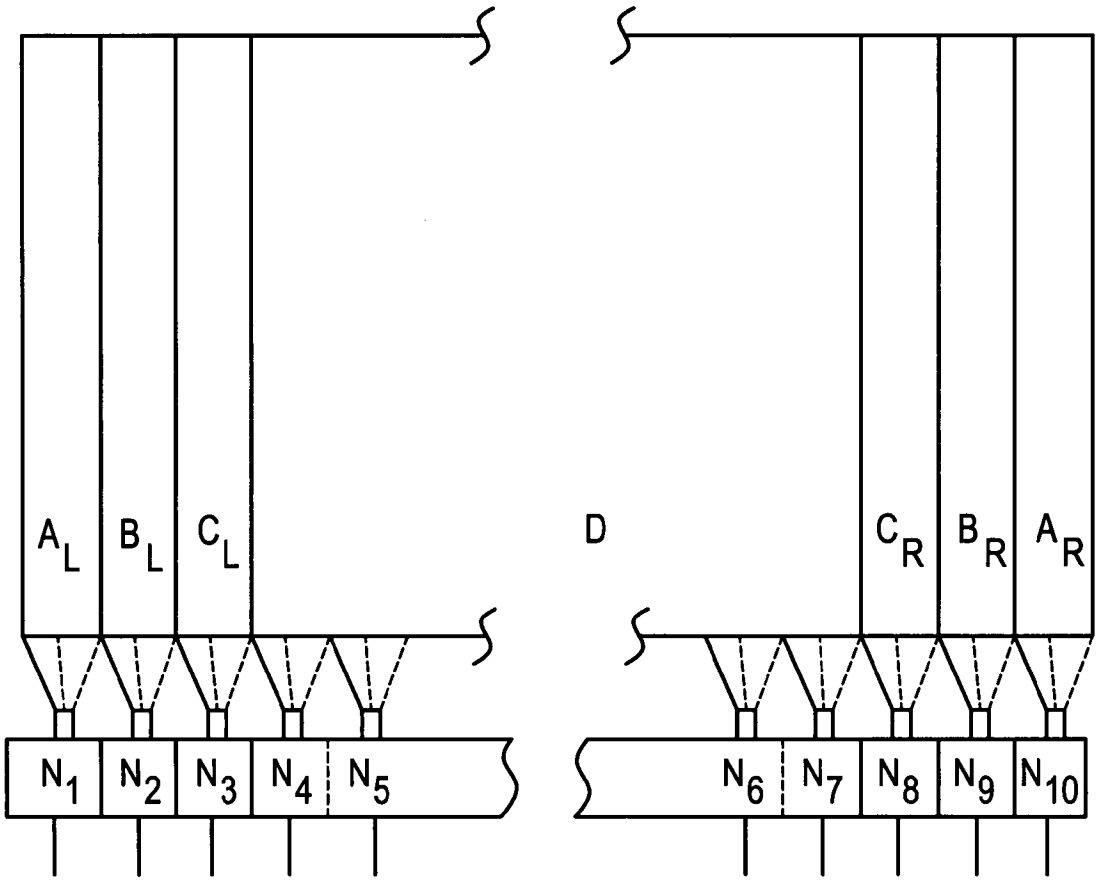
FIG. 3 shows the same configuration of equipment as is illustrated in FIG. 2, with the change being, each spray nozzle has its own intake pipe such that with this configuration, it is possible to apply a different Performance Enhancing Material to each Zone of the creping cylinder.

The means for targeted application of a desired Performance Enhancing Material to each Zone of said creping cylinder can be any means capable of applying a Performance Enhancing Material to one and only one location on the creping cylinder. For example, FIG. 3 shows a typical spraying operation, however, in FIG. 3, the Performance Enhancing Material supplied to each spray nozzle for targeted delivery onto each Zone of creping cylinder 30 has been divided up such that a different Performance Enhancing Material can be supplied and applied to each Zone.

Figure 4:
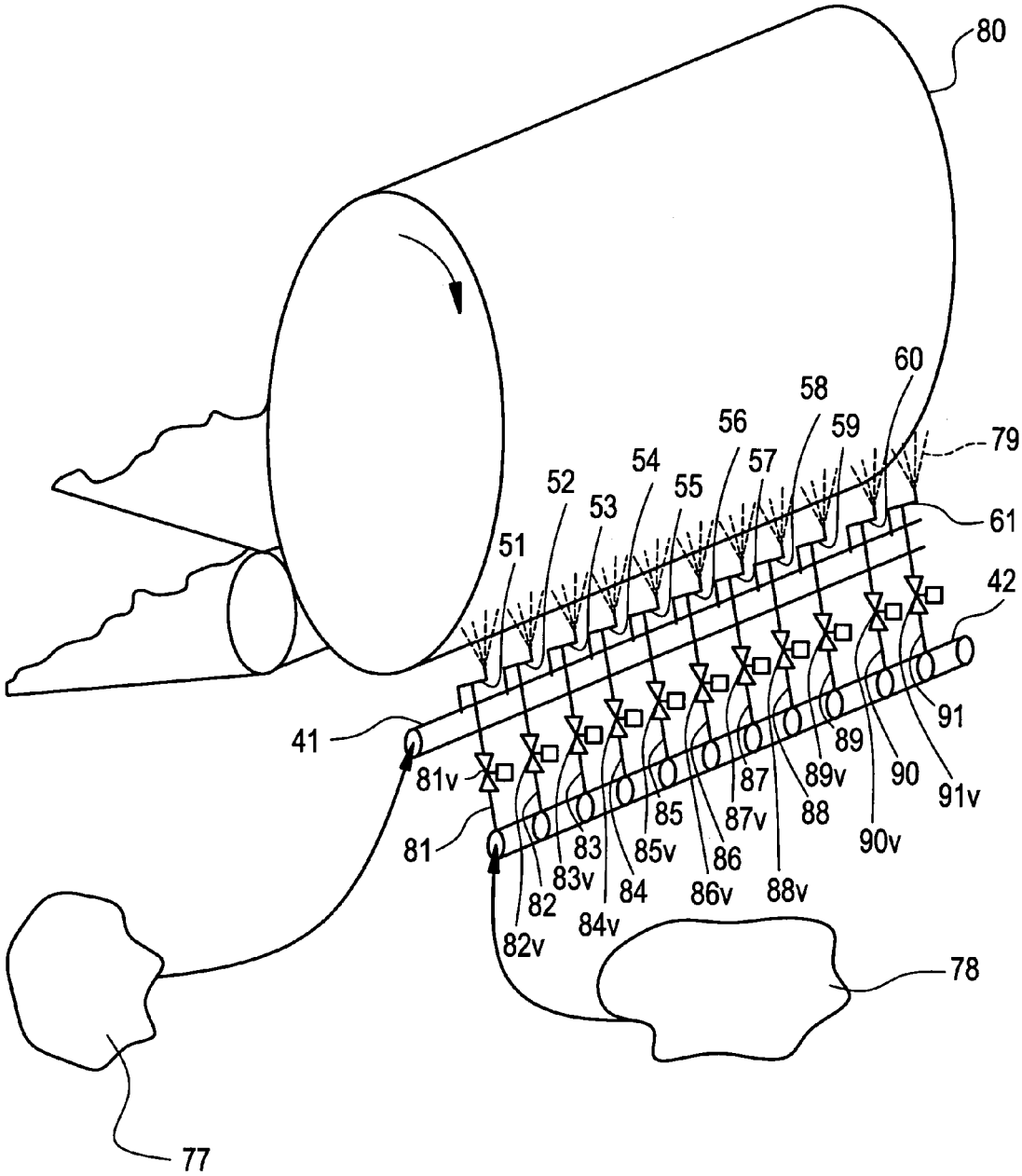
FIG. 4 shows a creping cylinder with a Primary Spray Boom, wherein each nozzle of the Primary Spray Boom, which applies a Primary Performance Enhancing Material also has an auxiliary feed line from a Secondary Spray Boom, which supplies a Secondary Performance Enhancing Material. With this equipment configuration it is possible to add a Secondary Performance Enhancing Material to the Primary Performance Enhancing Material so that the benefits of applying a mixture of the two Performance Enhancing Materials can be gained.

In FIG. 4, Primary Spray Boom 41, has pipes 51, 52, 53, 54, 55, 56, 57, 58, 59, 60 and 61 with attached spray nozzles, which all apply the same Performance Enhancing Material, 77. Secondary Spray Boom 42, has pipes, 81, 82, 83, 84, 85, 86, 87, 88, 89, 90 and 91, which feed into respective pipes 51, 52, 53, 54, 55, 56, 57, 58, 59, 60 and 61. Therefore, it is possible for Performance Enhancing Material 78 to be mixed in with Performance Enhancing Material 77, such that a Modified Performance Enhancing Material 79 is applied to creping cylinder 80.

In FIG. 4 it is also possible to close one, some or all of check valves 81*v*, 82*v*, 83*v*, 84*v*, 85*v*, 86*v*, 87*v*, 88*v*, 89*v*, 90*v* and 91*v* to allow for the application of just Performance Enhancing Material 77 in some Zones, the application of Modified Performance Enhancing Material 79 in some Zones and, with the inclusion in the apparatus of check valves on pipes 51, 52, 53, 54, 55, 56, 57, 58, 59, 60 and 61 (not depicted in FIG. 4, but easily added to the equipment setup) it is possible to apply Performance Enhancing Material 78 exclusively to some Zones. Using the apparatus depicted in FIG. 4 means it is possible to conduct the method of the instant claimed invention in many different, useful ways.

Performance Enhancing Material 77 is preferably the base coating which is typically applied across the entire creping cylinder. This base coating usually is an adhesive with an incorporated release agent that is applied as either an aqueous solution, although some adhesives may be applied in an aqueous dispersion or even in a non-aqueous solution or non-aqueous dispersion. Performance Enhancing Material 77 is selected from the group consisting of creping adhesives for preparing creped paper. Creping adhesives for preparing creped paper include, but are not limited to, the following: polyamines, polyamides, polyamidoamines, amidoamine-epichlorohydrin polymers, polyethyleneimines, polyvinyl alcohol, vinyl alcohol copolymers, polyvinyl acetate, vinyl acetate copolymers, polyethers, polyacrylic acid, acrylic acid copolymers, cellulose derivatives, starches, starch derivatives, animal glue, crosslinked vinylamine/vinylalcohol polymers as described in U.S. Pat. No. 5,374,334, glyoxalated acrylamide/diallyldimethyl acrylamide copolymers; the polymers described and claimed in U.S. Pat. No. 5,179,150; the polymers described and claimed in U.S. Pat. No. 5,167,219; an admixture of from about 0.1 to about 50 weight percent of a first polyamide-epihalohydrin resin and from about 99.9 to about 50 weight percent of a second polyamide-epihalohydrin resin, as described and claimed in U.S. Pat. No. 6,277,242 B1 and halogen-free creping cylinder adhesives based on cross linked cationic polyaminoamide polymers as described and claimed in U.S. Pat. No. 5,382,323.

Performance Enhancing Material 78 is selected based on the performance requirements of each Zone of the creping cylinder. If Performance Enhancing Material 78 is to be added to Performance Enhancing Material 77 and applied to a certain Zone or Zones, then Performance Enhancing Material 77 can be any material that is desired to add to the base coat to modify and improve the performance of the base coat, or, when no base coat is applied, Performance Enhancing Material 78 can be a specially formulated base coat.

For example, if there is a problem with the base coat in Zone A being too soft so that it wears or washes away too quickly or easily, then a double layer of base coat can be applied to just Zone A by having Performance Enhancing Material 78 be the same as Performance Enhancing Material 77, but configuring the spray booms such that both of the Performance Enhancing Materials are only applied to Zone $A_L$ and $A_R$.

Or Performance Enhancing Material 78 can be an entirely different adhesive, which is added to Performance Enhancing Material 77 only for application in Zones C and D. The addition of a different adhesive can be made to this Zone in partial or total replacement of the existing adhesive. The different adhesive can have a higher glass transition temperature $T_g$, or be more crosslinked, or have higher molecular weight, or be altered in another manner to achieve increased durability for this particular function. Commercially available adhesive products for this purpose are available from Ondeo Nalco Company located at Ondeo Nalco Center, 1601 W. Diehl Road, Naperville, Ill. 60563 (630) 305-1000 as Nalco® 690HA, Nalco® 663XDP and Nalco® 675P. Alternatively, a modifier can be added as Performance Enhancing Material 78 that crosslinks or alters the Performance Enhancing Material 77 to apply a Modified Performance Enhancing Material 79 with increased durability.

The ability to modify the existing Performance Enhancing Material 77 is most critical in Zone B, because unwanted deposits tend to build-up and cause serious detrimental effects to the Manufacture of tissue in Zone B. The modifying material added to the existing Performance Enhancing Material 77 is chosen so that it will soften the deposit. A softened deposit is highly desirable because a softened deposit can be removed through normal operation of the creping and cleaning doctors blades while still maintaining a good protective layer of coating material.

Performance Enhancing Material 78 designed specifically for application to Zone B is preferably a composition with the ingredients being one or more items selected from the group consisting of humectants, plasticizers, surfactants and low molecular weight polymers and mixtures thereof. A Performance Enhancing Material 78 for application to Zone B can be formulated to be applied with one ingredient in it or it can formulated to be applied with any or all of the following four ingredients in it: a humectant, a plasticizer; a surfactant, a low molecular weight polymer, or a mixture of one or more of any of these four materials.

For purposes of this patent application a "humectant" is a substance having affinity for water with stabilizing action on the water content of a material. A humectant keeps the moisture content caused by humidity fluctuations within a narrow range. The preferred humectant for application as a Performance Enhancing Material for Zone B is selected from the group consisting of low molecular weight water soluble polyols such as polyethylene glycol, propylene glycol, ethylene glycol, diethylene glycol, triethylene glycol, dipropylene glycol and glycerol. The more preferred humectant is selected from the group consisting of ethylene glycol and propylene glycol and glycerol. The most preferred humectant is glycerol.

The preferred amount of humectant in Performance Enhancing Material 78 for application to Zone B is from about 5 weight percent to about 90 weight percent. The more preferred amount of humectant in the composition of the dispersion or solution is from about 25 weight percent to about 70 weight percent. The most preferred amount of humectant in the composition of the dispersion or solution is about 40 weight percent.

A "plasticizer" is an organic compound added to a high polymer both to facilitate processing and to increase the flexibility and/or toughness of the Performance Enhancing Material. The preferred plasticizer for application to Zone B is selected from the group consisting of simple sugars such as glucose and fructose and sorbitol. The preferred plasticizer is sorbitol.

The preferred amount of plasticizer in Performance Enhancing Material 78 for application to Zone B is from about 10 weight percent to about 30 weight percent. The more preferred amount of plasticizer in the composition of the dispersion or solution is from about 15 weight percent to about 25 weight percent. The most preferred amount of plasticizer in the composition of the dispersion or solution is about 20 weight percent.

A "surfactant" is any compound that reduces surface tension when dissolved in water or water solutions, or that reduces interfacial tension between two liquids. The preferred surfactant for application to Zone B is selected from the group consisting of ethylene oxide homopolymers, propylene oxide homopolymers, ethylene oxide/propylene oxide copolymers (hereinafter "EO/PO" copolymers), fatty acid esters of ethylene oxide homopolymers, fatty acid esters of propylene oxide homopolymers, fatty acid esters of EO/PO copolymers, quaternary ammonium compounds, such as dialkyl dimethyl quaternaries, diamido amine quaternaries, dialkyl alkoxylated quaternaries, imidazoline quaternaries and imidazoline methyl sulfate. The more preferred surfactant is imidazoline methyl sulfate.

The preferred amount of surfactant in Performance Enhancing Material 78 for application to Zone B is from about 5 weight percent to about 20 weight percent. The more preferred amount of surfactant in the composition of the dispersion or solution is from about 10 weight percent to about 15 weight percent. The most preferred amount of surfactant in the composition of the dispersion or solution is 12 weight percent.

A "low molecular weight polymer" has a weight average molecular weight of from about 1000 to about 200,000. The preferred low molecular weight polymer for application to Zone B is selected from the group consisting of polyethylene glycols, polypropylene glycols, polyamines, polyamides, poly(amidoamines), polyvinyl alcohols, poly(amidoamine)-epi-chlorohydrin polymers (hereinafter "PAEs"), and modified polyethylene imine polymers (hereinafter "PEIs"). The more preferred low molecular weight polymer is selected from the group consisting of PAEs and PEIs.

The preferred amount of low molecular weight polymer in Performance Enhancing Material 78 for application to Zone B is from about 20 weight percent to about 40 weight percent. The more preferred amount of low molecular weight polymer in the composition of the dispersion or solution is from about 25 weight percent to about 35 weight percent. The most preferred amount of low molecular weight polymer in the composition of the dispersion or solution is about 30 weight percent.

The preferred composition of Performance Enhancing Material 78 for application to Zone B is one or several or all of the following:

a) glycerol;
b) sorbitol;
c) imidazoline methyl sulfate; and
d) poly(amidoamine)-epi-chlorohydrin polymers and modified polyethylene imine polymers.

It is understood that for application of Performance Enhancing Material 78 to Zone B that there is quite possibly overlap between the humectant and the plasticizer in Performance Enhancing Material 78. This is because certain humectants can also function as plasticizers and certain plasticizers can also function as humectants.

Figure 5:
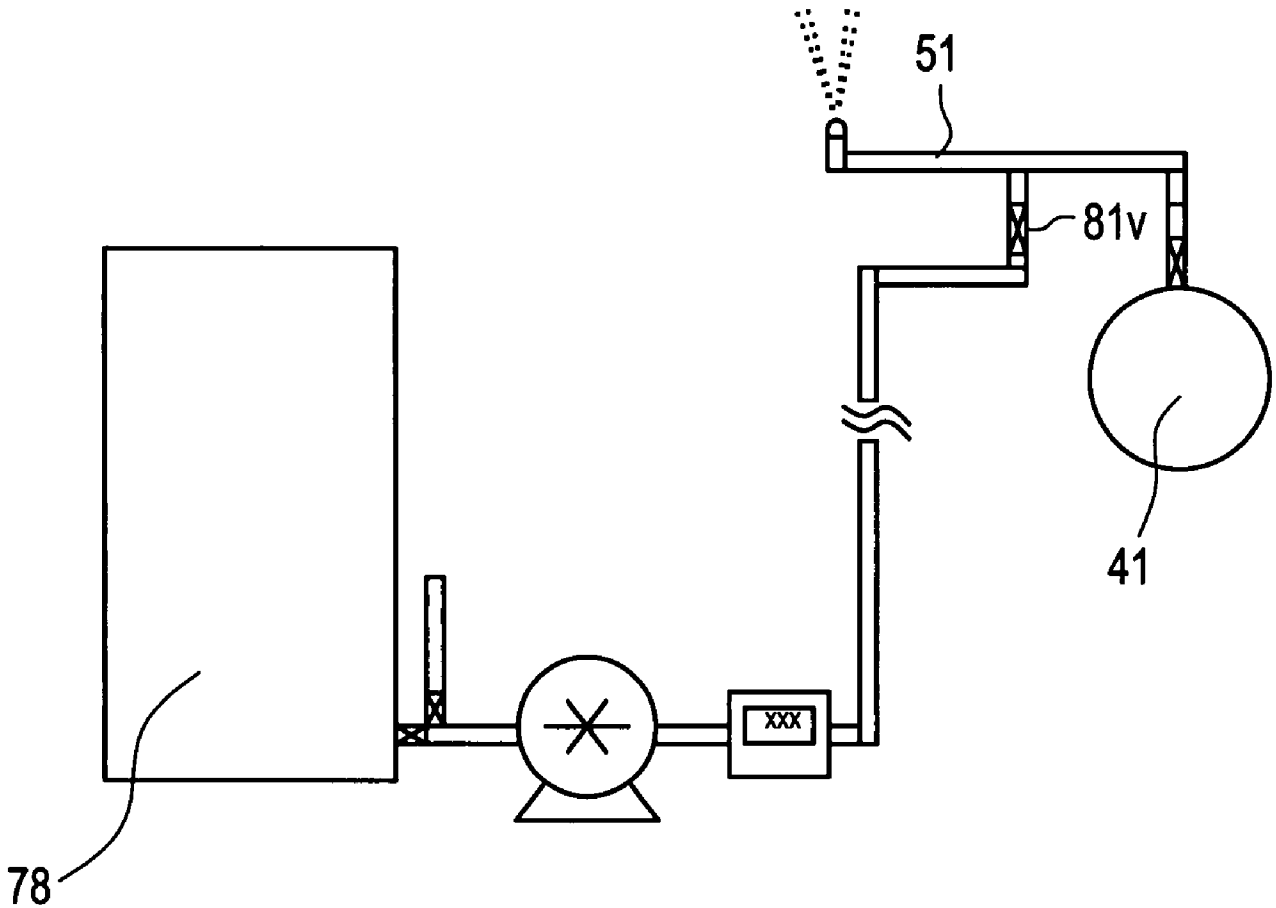
FIG. 5 shows an equipment setup wherein a pipe is linked to the nozzle feed pipe for a nozzle present on a spray boom. This equipment setup enables a secondary Performance Enhancing Material to be added to a nozzle to be applied to a certain targeted Zone of a creping cylinder.

The composition of Performance Enhancing Material 78 for application to Zone B is applied to the creping cylinder using any of the means for applying it that are available. The equipment setup in FIG. 4 can be used or the equipment set-up in FIG. 5 can be used, wherein only certain of the pipes are configured such that Performance Enhancing Material 78 can be added to Performance Enhancing Material 77 to create Performance Enhancing Material 79 which is the material actually applied to Zone B of creping cylinder 80.

In the same way that a preferred Performance Enhancing Material 78 can be formulated for application to Zone B, other preferred Performance Enhancing Materials 78 can be formulated for application to other Zones on the creping cylinder. If there is a lack of coating and protection in some part of another Zone, then the targeted delivery of increased, or a more resistant coating to this portion of the Zone can be practiced. Such targeted delivery can include the addition of a different adhesive to this Zone in partial or total replacement of the existing adhesive. The different adhesive can have a higher $T_g$, or be more crosslinked, or can have a higher molecular weight, or be altered in another manner to achieve increased durability. Alternatively, a modifier can be added that crosslinks or alters the coating to increase its durability. These modifiers should be known or readily ascertained to those skilled in the art of creping processes.

If there is a lack of adhesion in some part of another Zone, then an increased amount of the adhesive of the immediate coating composition may be target delivered to this portion of another Zone. Alternatively, a decreased amount of the release agent of the immediate coating composition may be target delivered to this portion of another Zone. Alternatively, a stronger adhesive may be target delivered to this portion of another Zone.

If there is too much coating build up in a portion of another Zone, such as Zone D, indicating that the coating is too hard, then the targeted addition of a modifying material to lower the coating build up can be made to this portion of Zone D. The modifying material will soften the coating so the build up of coating will be removed, while still maintaining a good protective layer of coating material. If too much adhesion occurs in a portion of Zone D, causing picking or other operational problems, then the adhesion in Zone C may be lowered by the targeted addition of more release of the immediate coating composition to this Zone. Alternatively a different stronger release can be used, such as a cationic surfactant of the imidazoline class. Alternatively a modifier may be added to this Zone such as a humectant or plasticizer to lower the adhesion.

In applying Performance Enhancing Materials to the Zones of a creping cylinder it is desirable to know whether the coating of the material is present all the way across the creping cylinder, it is also desirable to know how much of cylinder is coated with the coating and it is also desirable to know whether the coating is remaining on the cylinder or being removed from the cylinder either with the tissue or in the water removed from the felt. Methods to determine these items are described as follows.

A method to detect whether a Performance Enhancing Material is present on a creping cylinder comprising the steps of:

a) adding a known amount of an inert fluorescent tracer to a known amount of a Performance Enhancing Material, with said Performance Enhancing Material being suitable for application to a creping cylinder;
b) applying said Performance Enhancing Material to creping cylinder;
c) using a fluorometer to measure the fluorescent signal of said inert fluorescent tracer on said creping cylinder;
d) using the fluorescent signal of said inert fluorescent tracer to determine the amount of inert fluorescent tracer present on said creping cylinder;
e) correlating the amount of inert fluorescent tracer present on said creping cylinder with the amount of Performance Enhancing Material present on said creping cylinder;
f) comparing the amount of Performance Enhancing Material present on said creping cylinder with the desired amount of Performance Enhancing Material that is supposed to be present on said creping cylinder; and optionally
g) adjusting the amount of Performance Enhancing Material present on said creping cylinder, based on the measured fluorescent signal of said inert fluorescent tracer.

Fluorescent tracers suitable for use in the method of the instant claimed invention are those inert fluorescent materials that have a fluorescent signal that can be measured using a fluorometer. All inert fluorescent tracer materials suitable for use in the method of the instant claimed invention must be selected such that their fluorescent signal is still detectable without masking of the signal by background fluorescence present in the Performance Enhancing Material. Masking of the signal is defined as background fluorescence at the excitation wavelength greater than a 5% threshold with respect to the signal of the inert fluorescent tracer.

The meaning of the term "inert", as used herein is that an inert fluorescent tracer is not appreciably or significantly affected by any other chemistry in the Performance Enhancing Material or metal surface of said creping cylinder. To quantify what is meant by "not appreciably or significantly affected", this statement means that an inert fluorescent compound has no more than a 10% change in its fluorescent signal, under conditions normally encountered on creping cylinders with one or more Performance Enhancing Material(s). present on the surface.

Suitable inert fluorescent tracer include, but are not limited to, 1,5-naphthalenedisulfonic acid disodium salt (1,5-NDSA),
2-amino-1-naphthalenesulfonic acid,
5-amino-2-naphthalenesulfonic acid,
4-amino-3-hydroxyl-1-naphthalenesulfonic acid,
6-amino-4-hydroxyl-2-naphthalenesulfonic acid,
7-amino-1,3-naphthalenedisulfonic acid, potassium salt,
4-amino-5-hydroxy-2,7-naphthalenedisulfonic acid,
5-dimethylamino-1-naphthalenesulfonic acid,
2,6-naphthalenedicarboxylic acid, dipotassium salt,
2-anthracenesulfonic acid, sodium salt, quinoline (CAS Registry No. 91-22-5),
1-ethylquinaldinium iodide,
dibenzofuransulfonic acid,
Brilliant Acid Yellow 8G (CAS Registry No. 2391-30-2, i.e. Lissamine Yellow FF, Acid Yellow 7),
cresyl violet acetate (CAS Registry No. 10510-54-0),
Safranine O (CAS Registry No. 477-73-6),
bathophenanthrolinedisulfonic acid disodium salt (CAS Registry No. 52746-49-3),
Titan Yellow (CAS Registry No. 1829-00-1, i.e. Thiazole Yellow G),
Celestine Blue (CAS Registry No. 1562-90-9),
Sandoz CW (CAS Registry No. 56509-06-9, i.e. Flu. Bright, 235),
Sandoz CD (CAS Registry No. 16470-24-9, i.e. Flu. Bright. 220),
Sandoz TH-40 (CAS Registry No. 32694-95-4),
Tinopal 5BM-GX (CAS Registry No. 169762-28-1),
Keyfluor White ST (CAS Registry No. 144470-48-4, i.e. Flu. Bright. 28),
Phorwite CL (CAS Registry No. 12270-53-0, i.e. Flu. Bright. 191),
Phorwite BKL (CAS Registry No. 61968-72-7, i.e. Flu. Bright. 200),
Leucophor BSB (CAS Registry No. 68444-86-0, i.e. Leucophor AP, Flu. Bright. 230),
Leucophor BMB (CAS Registry No. 16470-24-9, i.e. Leucophor U, Flu. Bright. 290),
Keyfluor White CN (CAS Registry No. 16470-24-9),
Tinopol DCS (CAS Registry No. 205265-33-4),
1-amino-4-naphthalene sulfonic acid,
1-amino-7-naphthalene sulfonic acid,
amino 2,5-benzene disulfonic acid,
1,3,6,8-pyrenetetrasulfonic acid, tetrasodium salt,
8-hydroxy-1,3,6-pyrenetrisulfonic acid, trisodium salt (i.e. Pyranine),
3,4,9,10-perylenetetracarboxylic acid,
bis-N-methylacridinium (i.e. Lucigenin),
2-(4-aminophenyl)-6-methylbenzothiazole,
fluorescein (CAS Registry No. 2321-07-5, i.e. Acid Yellow 73, Uranine),
Sulforhodamine B (CAS Registry No. 3520-42-1, i.e. Acid Red 52),
Rhodamine WT (CAS Registry No. 37299-86-8),
Resazurin (CAS Registry No. 550-82-3),
Rhodalux (CAS Registry No. 550-82-3),
Anthrasol Green IB (CAS Registry No. 2538-84-3, i.e. Solubilized Vat Dye),
Acridine Orange (CAS Registry No. 65-61-2),
Phorwite BHC 766 (CAS Registry No. 52237-03-3),
Tinopal CBS-X (CAS Registry No. 27344-41-8),
Tinopal RBS 200,
Pylaklor White S-15A (CAS Registry No. 6416-68-8) and their ammonium, potassium and sodium salts.

The preferred inert fluorescent tracer is 1,3,6,8-pyrenetetrasulfonic acid, tetrasodium salt.

All of these inert fluorescent tracers are either available commercially from Ondeo Nalco Company, Ondeo Nalco Center, Naperville Ill. 60563 (630) 305-1000, or other commercial chemical supply companies, or can be synthesized using techniques known to people of ordinary skill in the art.

The selection of which inert fluorescent tracer to use is based on matching the fluorescent tracer to the Performance Enhancing Material. The method used to select the optimum inert fluorescent tracer is to use a fluorometer to detect whatever fluorescent signals are present on a creping cylinder coated with a specific Performance Enhancing Material. Then an inert fluorescent tracer is added to the Performance Enhancing Material and the fluorometer is used to detect its fluorescent signal on the creping cylinder that the Performance Enhancing Material is placed in. If it is not possible to detect the fluorescent signal of the inert fluorescent tracer, due to background fluorescence, or interference from the fluorescent signal of the Performance Enhancing Material itself, then either more inert fluorescent tracer can be used, or an alternative inert fluorescent tracer can be selected for use with that Performance Enhancing Material. The alternative inert fluorescent tracer is selected such that its excitation and emission wavelengths are different than those of the background fluorescent signal(s) and the fluorescent signal of the Performance Enhancing Material. This method of selection of inert fluorescent tracer can be accomplished without undue experimentation.

Fluorometers suitable for use in the instant claimed invention are commercially available from Ondeo Nalco Company. The fluorometer chosen must be capable of detecting and measuring the fluorescent signal (emission light) from the inert fluorescent tracer used. The selection of which fluorometer to use is known to people of ordinary skill in the art of fluorometry.

Another method using inert fluorescent tracers is as follows:

A method to detect whether a Performance Enhancing Material is present on a creped tissue product comprising the steps of:

a) adding a known amount of an inert fluorescent tracer to a known amount of a Performance Enhancing Material, with said Performance Enhancing Material being suitable for application to a creping cylinder;

b) applying said Performance Enhancing Material to a creping cylinder;

c) using a fluorometer to measure the fluorescent signal of said inert fluorescent tracer on the creped tissue leaving said creping cylinder and repeating this measurement as required in order to determine the pattern of the presence and amount of said Performance Enhancing Material on said creped tissue;

d) using the pattern of the presence and amount of said Performance Enhancing Material on said creped tissue to ascertain whether the application of Performance Enhancing Material to said creping cylinder is optimal; and optionally;

e) adjusting the amount of Performance Enhancing Material present on said creping cylinder, based on the pattern of the presence and amount of said Performance Enhancing Material on said creped tissue.

In this method, the fluorometer is used to detect the fluorescent signal of the inert fluorescent material on the creped tissue itself and this information is used to determine whether the Performance Enhancing Material has the desired, optimal flow pattern across the creping cylinder such that the adhesion, runnability and release properties of the tissue are as desired. The inert fluorescent tracers useful for this method, may include those that visibly fluoresce when a "black light" is shined on them. These types of visible fluorescent moieties are known to those people skilled in the art and are available commercially.

Another method useful in operating a creping cylinder is a method to detect whether the correct amount and type of Performance Enhancing Materials are present on a creping cylinder comprising the steps of:

a) adding a known amount of an inert fluorescent tracer to a known amount of a Performance Enhancing Material, with said Performance Enhancing Material being suitable for application to a creping cylinder;

b) applying said Performance Enhancing Material to creping cylinder;

c) using a fluorometer to measure the fluorescent signal of said inert fluorescent tracer in the collected water removed from the felt;

d) using the fluorescent signal of said inert fluorescent tracer to determine the amount of inert fluorescent tracer present in the collected water removed from the felt;

e) correlating the amount of inert fluorescent tracer present in said collected water removed from the felt with the amount of Performance Enhancing Material present in said water removed from the felt;

f) comparing the amount of Performance Enhancing Material present in the water removed from the felt with the desired amount of Performance Enhancing Material that is supposed to be present on said creping cylinder; and optionally g) adjusting the amount and type of Performance Enhancing Material present on said creping cylinder, based on the measured fluorescent signal of said inert fluorescent tracer that is in the water removed from the felt.

This method is useful when it is suspected that the Performance Enhancing Material is not adhering to the creping cylinder in the desired fashion. With this method, if "too much" of the Performance Enhancing Material is found in the water removed from the felt, then the operating parameters of the creping cylinder can be adjusted until the "just right" amount of Performance Enhancing Material is found in the wash water. People skilled in the art of creping cylinder processes know how much Performance Enhancing Material should be present on a creping cylinder and how much Performance Enhancing Material is present in the water removed from the felt.

In addition to adjusting the amount of Performance Enhancing Material present on the creping cylinder, this method also allows for adjusting the composition of the Performance Enhancing Material present so that there is an optimal amount of Performance Enhancing Material adhering to the creping cylinder at any given time.

Although the invention has been described in detail for the purpose of illustration, it is to be understood that such detail is solely for that purpose and that numerous modifications, alterations and changes can be made therein by those skilled in the art without departing from the spirit and scope of the invention except as it may be limited by the claims. All changes which come within the meaning and range of equivalency of the claims are to be embraced within their scope.

What is claimed is:

1. A method for targeted application of non-gaseous Performance Enhancing Materials to a creping cylinder comprising the steps of:

a) providing a tissue making operation wherein a rotating creping cylinder is used to dry a wet mat of fibrous material wherein said mat of fibrous material is contacted with a doctor blade that crepes the fibrous mat as it leaves the creping cylinder;

b) dividing said creping cylinder into a plurality of Zones, wherein each Zone has a performance requirement and operating temperature range that is different than the adjacent Zone;

c) providing means for targeted application of one or more desired Performance Enhancing Materials to each Zone of said creping cylinder; and d) applying one or more Performance Enhancing Materials to at least two Zones of said creping cylinder, wherein the Performance Enhancing Material applied to each Zone is selected based on the performance requirement and operating temperature range of each Zone of said creping cylinder.

2. A method to detect whether a Performance Enhancing Material is present on a creping cylinder comprising the steps of:

a) adding a known amount of an inert fluorescent tracer to a known amount of a Performance Enhancing Material, with said Performance Enhancing Material being suitable for application to a creping cylinder;

b) applying said Performance Enhancing Material to the creping cylinder;

c) using a fluorometer to measure a fluorescent signal of said inert fluorescent tracer on said creping cylinder;

d) using the fluorescent signal of said inert fluorescent tracer to determine the amount of inert fluorescent tracer present on said creping cylinder;

e) correlating the amount of inert fluorescent tracer present on said creping cylinder with the amount of Performance Enhancing Material present on said creping cylinder;

f) comparing the amount of Performance Enhancing Material present on said creping cylinder with the desired amount of Performance Enhancing Material that is supposed to be present on said creping cylinder; and optionally g) adjusting the amount of Performance Enhancing Material present on said creping cylinder, based on the measured fluorescent signal of said inert fluorescent tracer.

3. A method to detect whether a Performance Enhancing Material is present on a creped tissue product comprising the steps of:

a) adding a known amount of an inert fluorescent tracer to a known amount of a Performance Enhancing Material, with said Performance Enhancing Material being suitable for application to a creping cylinder;

b) applying said Performance Enhancing Material to a creping cylinder;

c) using a fluorometer to measure a fluorescent signal of said inert fluorescent tracer on the creped tissue leaving said creping cylinder and repeating this measurement as required in order to determine the pattern of the presence and amount of said Performance Enhancing Material on said creped tissue;

d) using the pattern of the presence and amount of said Performance Enhancing Material on said creped tissue to ascertain whether the application of Performance Enhancing Material to said creping cylinder is optimal; and optionally;

e) adjusting the amount of Performance Enhancing Material present on said creping cylinder, based on the pattern of the presence and amount of said Performance Enhancing Material on said creped tissue.

4. A method to detect whether the correct amount and type of Performance Enhancing Materials are present on a creping cylinder comprising the steps of:

a) adding a known amount of an inert fluorescent tracer to a known amount of a Performance Enhancing Material, with said Performance Enhancing Material being suitable for application to a creping cylinder;

b) applying said Performance Enhancing Material to creping cylinder;

c) using a fluorometer to measure a fluorescent signal of said inert fluorescent tracer in the collected water removed from a felt;

d) using the fluorescent signal of said inert fluorescent tracer to determine the amount of inert fluorescent tracer present in the collected water removed from the felt;

e) correlating the amount of inert fluorescent tracer present in said collected water removed from the felt with the amount of Performance Enhancing Material present in said water removed from the felt;

f) comparing the amount of Performance Enhancing Material present in the water removed from the felt with the desired amount of Performance Enhancing Material that is supposed to be present on said creping cylinder; and optionally g) adjusting the amount and type of Performance Enhancing Material present on said creping cylinder, based on the measured fluorescent signal of said inert fluorescent tracer found in the water removed from the felt.

* * * * *